US009435015B2

(12) United States Patent
Takeda et al.

(10) Patent No.: US 9,435,015 B2
(45) Date of Patent: Sep. 6, 2016

(54) HEAT TREATMENT METHOD AND HEAT TREATMENT APPARATUS

(75) Inventors: Mahoto Takeda, Yokohama (JP); Naokuni Muramatsu, Nagoya (JP); Ryota Takeuchi, Handa (JP)

(73) Assignees: NGK Insulators, Ltd., Nagoya (JP); Yokohama National University, Yokohama (JP)

( * ) Notice: Subject to any disclaimer, the term of this patent is extended or adjusted under 35 U.S.C. 154(b) by 821 days.

(21) Appl. No.: 13/617,056

(22) Filed: Sep. 14, 2012

(65) Prior Publication Data

US 2013/0000792 A1 Jan. 3, 2013

Related U.S. Application Data

(63) Continuation of application No. PCT/JP2011/075077, filed on Oct. 31, 2011.

(30) Foreign Application Priority Data

Nov. 1, 2010 (JP) ..... 2010-245515

(51) Int. Cl.

| | |
|---|---|
| ***C22F 1/08*** | (2006.01) |
| ***C22F 1/00*** | (2006.01) |
| ***C21D 9/52*** | (2006.01) |
| ***C22F 1/047*** | (2006.01) |

(52) U.S. Cl.

CPC . *C22F 1/08* (2013.01); *C21D 9/52* (2013.01); *C22F 1/00* (2013.01); *C22F 1/047* (2013.01)

(58) Field of Classification Search

CPC ..... C21D 9/52; C21D 8/0431; C22F 1/08
USPC ..... 148/679
See application file for complete search history.

(56) References Cited

U.S. PATENT DOCUMENTS

| | | | |
|---|---|---|---|
| 2009/0229715 | A1 | 9/2009 | Takahashi et al. |
| 2011/0318603 | A1 | 12/2011 | Okuda et al. |

FOREIGN PATENT DOCUMENTS

| | | | | |
|---|---|---|---|---|
| JP | 06-073444 | A1 | | 3/1994 |
| JP | 06073444 | A | * | 3/1994 |
| JP | 06-272003 | A1 | | 9/1994 |
| JP | 2003-053415 | A1 | | 2/2003 |
| JP | 2009-299104 | A1 | | 12/2009 |
| JP | 2010-077465 | A1 | | 4/2010 |
| JP | 2010-209452 | A1 | | 9/2010 |
| WO | 2008/029855 | A1 | | 3/2008 |

OTHER PUBLICATIONS

Japanese Office Action (Application No. 2012-541854) dated Dec. 16, 2014.

International Search Report and Written Opinion dated Jan. 31, 2012.

* cited by examiner

*Primary Examiner* — Weiping Zhu
(74) *Attorney, Agent, or Firm* — Burr & Brown, PLLC

(57) ABSTRACT

A heat treatment method according to the present invention includes a preliminary-state-generating step of heat-treating an alloy that undergoes multiple-step transformation with temperature by bringing the alloy in contact with a contact-type heating element for 0.01 sec or more and 3.0 sec or less, the contact-type heating element being adjusted to a particular temperature within a preliminary-state-generating temperature region determined on the basis of a first temperature related to a particular first transformation of the alloy and a second temperature, which is higher than the first temperature, related to a particular second transformation of the alloy so as to generate a preliminary state in the alloy.

10 Claims, 11 Drawing Sheets

HEAT TREATMENT METHOD AND HEAT TREATMENT APPARATUS

BACKGROUND OF THE INVENTION

1. Field of the Invention

The present invention relates to a heat treatment method and a heat treatment apparatus.

2. Description of Related Art

Hot working and warm working of metal ribbons have been carried out by heat-treating a metal ribbon in a heating vessel that extends in the machine direction and then rolling the preheated metal ribbon using many rolling rolls after the heat treatment. However, with this method, the process takes a long time and involves multiple steps, thereby making it difficult to homogenize the microstructure or accurately impart high-performance material properties. To address this difficulty, for example, a proposal has been made in which temperature-controlled single rolls are arranged in a zigzag pattern and a thin sheet is passed through the single rolls while in contact with the rolls so that the two surfaces of the thin sheet are alternately heated (e.g., refer to Patent Literature 1).

Patent Literature 1: Japanese Unexamined Patent Application Publication No. 6-272003

SUMMARY OF THE INVENTION

Alloys that undergo multiple-step transformation with temperature are sometimes required to contain an increased amount of a phase obtained at an intermediate stage of transformation (hereinafter this phase is also referred to as "intermediate phase") in order to achieve desired properties. However, merely extending the heat-treatment time or elevating the heat-treatment temperature has sometimes resulted in enhancement of a transformation that occurs at a temperature higher than desired and it has been difficult to increase the amount of the intermediate phase to a particular level or higher.

The present invention has been made to address such a difficulty and aims to provide a heat treatment method and a heat treatment apparatus that can form a more desirable phase by heat-treating an alloy that undergoes multiple-step transformation with temperature.

The inventors of the present invention have conducted extensive studies to achieve the object and have thus found that in the case of a Cu—Be alloy that undergoes multiple step transformation and precipitation transformation occurring in the order of a G-P zone, a γ" phase, a γ' phase, and a γ phase, precipitation of the γ phase can be suppressed in the subsequent heat-treatment if a preliminary state is generated by bringing the alloy into contact with heating rolls heated to a temperature equal to or more than the temperature at which the G-P zone precipitates but not more than the temperature at which the γ phase occurs, for a predetermined amount of time. Thus, the present invention has been made.

A heat treatment method for heat-treating an alloy that undergoes multiple-step transformation with temperature in the present invention, the method comprises: a preliminary-state-generating step of heat-treating the alloy by bringing the alloy in contact with a contact-type heating element for 0.01 sec or more and 3.0 sec or less, the contact-type heating element being adjusted to a particular temperature within a preliminary-state-generating temperature region determined on the basis of a first temperature related to a particular first transformation of the alloy and a second temperature, which is higher than the first temperature, related to a particular second transformation of the alloy so as to generate a preliminary state in the alloy.

A heat treatment apparatus for heat-treating an alloy that undergoes multiple-step transformation with temperature in the present invention comprises: a contact-type heating element that heats the alloy by making contact; and a controller configured to bring the alloy in contact with the contact-type heating element for 0.01 sec or more and 3.0 sec or less, the contact-type heating element being adjusted to a particular temperature within a preliminary-state-generating temperature region determined on the basis of a first temperature related to a particular first transformation of the alloy and a second temperature, which is higher than the first temperature, related to a particular second transformation of the alloy.

According to the heat treatment method and heat treatment apparatus of the present invention, a more desirable phase can be generated by heat-treating an alloy that undergoes multiple-step transformation with temperature. Although the reason for this is not clear, the inventors believe that, although long hours of heating and/or heating at high temperatures may promote transformation that occurs at a higher-temperature side in an alloy that undergoes multiple-step transformation, such enhancement of the transformation can be suppressed by creating a preliminary state in which some substances that will form nuclei of the intermediate phase are present.

DETAILED DESCRIPTION OF THE INVENTION

Figure 1:
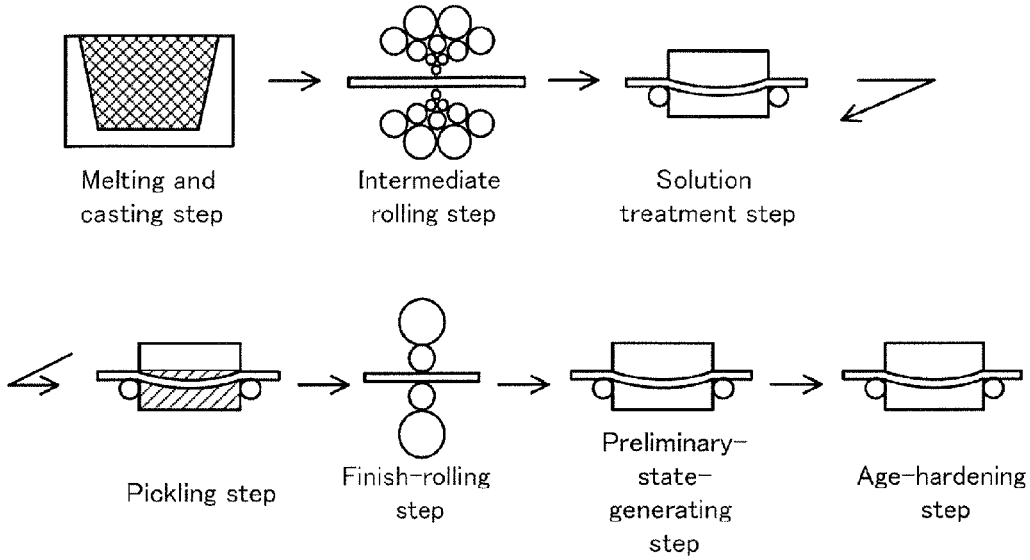
FIG. 1 is a diagram illustrating an example of a method for producing an alloy ribbon, the method including a heat treatment method of the present invention.

A heat treatment method according to the present invention is a method conducted on an alloy that undergoes multiple-step transformation with temperature. FIG. 1 is a diagram illustrating an example of a method for producing an alloy ribbon, the method including a preliminary-state-generating step which is a heat treatment method of the present invention. This method may include a melting and casting step of melting raw materials so that an alloy composition that will undergo multiple-step transformation with temperature is produced and casting the resulting melt, and an intermediate rolling step of cold-rolling an ingot of this alloy to a desired thickness to obtain a crude alloy ribbon. This method may also include a solution treatment step of heating and quenching the crude alloy ribbon to supersaturatedly dissolve precipitation-hardening-type elements, a pickling step of washing the solution-treated crude alloy ribbon, and a finish-rolling step of cold-rolling the ribbon to a required thickness. The method may also include a preliminary-state-generating step of generating a particular preliminary state in the finish-rolled crude alloy ribbon, and an aging step which is a main heat-treatment step of inducing precipitation of a second phase and a particular intermediate phase by using an age-hardening treatment. The term "particular intermediate phase" refers to a phase which is desirable for obtaining a desired property and is obtained in an intermediate step of transformation. The term "ribbon" refers to a foil or a sheet having a thickness of 3.00 mm or less. A ribbon may have a thickness of 0.10 mm or more. Although the preliminary-state-generating step is carried out between the finish-rolling step and the age-hardening step in FIG. 1, the order is not limited to this. For example, the preliminary-state-generating step may be carried out between the solution treatment step and the pickling step or between the pickling step and the finish-rolling step. As such, the preliminary-state-generating step may be carried out any time after the solution treatment step and before the age-hardening step. In the heat treatment method of the present invention, the preliminary-state-generating step is carried out to induce precipitation of large amounts of the intermediate phase in the age-hardening step and to suppress precipitation of undesirable phases (hereinafter also referred to as unneeded phases). The preliminary-state-generating step and the age-hardening step will now be described in detail.

The alloy used in the present invention may be any alloy that undergoes multiple-step transformation with temperature. Examples thereof include those having alloy compositions of a precipitation-hardening type. An example of an alloy that undergoes multiple-step transformation with temperature is an alloy that exhibits two or more peaks when subjected to differential scanning calorimetry (DSC). Examples of such an alloy composition include 300 series and 600 series stainless steel, 2000, 6000, and 7000 series aluminum alloys, and copper alloys. Among these, copper alloy ribbons are preferred since they have high electrical conductivities and are frequently used in electronic parts. Examples of such copper alloys include Cu—Be alloys, Cu—Ni—Si alloys, Cu—Ti alloys, Cu—Fe alloys, and Cu—Cr—Zr alloys. All of these alloy systems are systems in which precipitation of a second phase occurs from a supersaturated solid solution. Among these, Cu—Be alloys are preferred. For example, a Cu—Be alloy preferably contains 1.8% by mass or more and 2.0% by mass or less of Be and 0.2% by mass or more of Co. The Cu—Ni—Si alloy preferably contains 1.3% by mass or more and 2.7% by mass or less of Ni and 0.2% by mass or more and 0.8% by mass or less of Si, for example. The Cu—Ti alloy preferably contains 2.9% by mass or more and 3.5% by mass or less of Ti. The Cu—Fe alloy preferably contains about 0.2% by mass of Fe. The Cu—Cr—Zr alloy preferably contains 0.5% by mass or more and 1.5% by mass or less of Cr and 0.05% by mass or more and 0.15% by mass or less of Zr, for example. The basic idea of this technique is also applicable to solid-solution-strengthening alloys in which strengthening is achieved because maximum amounts of solute elements form solid solutions through quenching and spinodal decomposition-type alloys in which strengthening is achieved through generation of periodic modulated structures induced by decomposition of supersaturated solid solutions during aging treatment, although these types of alloys are to be distinguished from the precipitation-hardening-type alloys in view of the strengthening mechanism in a narrow sense.

In the preliminary-state-generating step of the present invention, the alloy is heated by being brought into contact with a contact-type heating element adjusted to a particular temperature within a preliminary-state-generating temperature region determined on the basis of a first temperature which relates to a particular first transformation of the alloy and a second temperature which is higher than the first temperature and relates to a particular second transformation of the alloy. The contact time is 0.01 sec or more and 3.0 sec or less and a preliminary state is generated in the alloy as a result. This preliminary-state-generating step is a heat treatment conducted prior to a main heat-treatment step (e.g., an age-hardening step) and includes rapidly heating the alloy so as to suppress generation of unneeded phases during heating and cooling in the main heat treatment step and to induce the alloy to enter a preliminary state, as a result of which an increased amount of intermediate phase is generated by heating and cooling in the main heat treatment step. The term "preliminary state" includes, for example a state in which nuclei of the intermediate phase are generated or about to be generated. The first transformation and the second transformation may be any of the transformations of an alloy that undergoes multiple-step transformation and are different from each other. The first transformation is a transformation that occurs at a lower-temperature side and the second transformation is a transformation that occurs at a higher-temperature side. The phase of the first transformation may be a preferable phase and the phase of transformation that occurs at a temperature higher than the second transformation may be an unneeded phase. The first temperature related to the first transformation may be, for example, a temperature at which the first transformation begins, becomes most active, or ends. Such a temperature can be determined by, for example, DSC. In the DSC results, the temperature at the rising edge of the peak may be assumed to be the temperature at which the first transformation begins, the peak temperature may be assumed to be the temperature at which the first transformation becomes most active, and the temperature at which the peak is passed and becomes flat or the temperature immediately before the rising edge of the next peak may be assumed to be the temperature at which the first transformation ends. The second temperature related to the second transformation can be set in the same manner. The preliminary-state-generating temperature region can be determined on the basis of the first temperature and the second temperature and may be, for example, the first temperature or more and the second temperature or less. The preliminary-state-generating temperature region may be determined by taking into consideration the thermal conduction or dissipation from the contact-type heating element or may be empirically determined. For example, the first temperature may be set to the peak temperature of the first transformation of the alloy determined by DSC, the second temperature may be set to the temperature of the rising edge of the second transformation determined by DSC, and the preliminary-state-generating temperature region may be set to a temperature region higher than the first temperature but lower than the second temperature. In this manner, since the first transformation or nucleation of the first transformation occurs without fail and transformation at a temperature higher than the second transformation (unneeded phases) rarely occurs, a more preferable preliminary state can be obtained.

In the preliminary-state-generating step, heat treatment is conducted by bringing the alloy into contact with a contact-type heating element set to a particular temperature within the preliminary-state-generating temperature region for a contact time of 0.01 sec or more and 3.0 sec or less. When the contact time is 0.01 sec or more, the alloy can enter a satisfactory preliminary state. When the contact time is 3.0 sec or less, precipitation of unneeded phases can be further suppressed. The contact time is more preferably 0.1 sec or more and most preferably 1.0 sec or more. The contact time is more preferably 2.9 sec or less and most preferably 2.8 sec or less. In the preliminary-state-generating step of the present invention, the heating rate of the alloy is preferably 70° C./sec or more and more preferably 180° C./sec or more, and most preferably 200° C./sec or more. A higher heating rate is preferred since generation of unneeded phases can be further suppressed. The heating rate is preferably 250° C./sec or less in view of ease of heating. The preliminary-state-generating step may be carried out in an air atmosphere or the like but is preferably carried out in an inert gas atmosphere. The preliminary-state-generating step may be carried out while spraying inert gas toward the heated surface. Heating is preferably conducted in a vertically symmetrical manner in the width direction of the alloy ribbon at an accuracy of ±2.0° C. or less. The heating rate of the alloy may be, for example, a heating rate from the heating onset temperature to the heating end temperature of the alloy or may be a value of the difference in temperature between the contact-type heating element and the alloy before heating divided by the time of contact between the contact-type heating element and the alloy.

In the preliminary-state-generating step of the present invention, the alloy can be rapidly heated by bringing the alloy into contact with the contact-type heating element. Preferably, pairs of heating rolls equipped with heating mechanisms are used as the contact type heating element and the heat treatment is conducted while continuously moving the alloy ribbon held between the paired heating rolls. In this manner, the alloy ribbon can be efficiently heated from both sides and can be rapidly heated. Use of paired heating rolls can decrease the heat capacity of one heating roll compared to when single rolls are used. Moreover, when the alloy ribbon makes contact with the pairs heating rolls, the linear region in contact with the rolls are heated simultaneously from a front side and a rear side. Thus, heating nonuniformity rarely occurs and the shape can be satisfactorily maintained. When the shape is satisfactorily maintained, the step or equipment (e.g., a leveler) needed to correct shape can be omitted, which is preferable. Moreover, continuous and uniform heat treatment can be performed. The clearance between the paired heating rolls can be determined on the basis of the thickness of the alloy ribbon to be obtained. From the viewpoint of contact-heating the alloy, the clearance is preferably equal to or less than the crude alloy ribbon. The heating rolls are preferably rotated so that the tangential velocity is coincident with the traveling speed of the ribbon. The tangential velocity can be empirically determined by considering the size of the heating rolls, the contact area between the heating rolls and the alloy ribbon, etc., so that the time of contact between the alloy ribbon and the heating rolls is within the aforementioned range.

In the preliminary-state-generating step of the present invention, the contact-type heating element may be configured to heat the alloy ribbon while applying a pressure or without applying a pressure. In the case where the alloy ribbon is heated under pressure, the heat treatment is preferably conducted while rolling the alloy ribbon so that the reduction (processing ratio) achieved by the contact-type heating element is 0.01% or more and 10% or less. This is presumably because when heat treatment is carried out while applying strains as such, generation of the preliminary state in the preliminary-state-generating step is accelerated and the variation in the direction in which the intermediate phase is generated is suppressed. The processing ratio dh (%) is to be determined from the thickness $h_0$ (mm) of the alloy ribbon before processing and the thickness $h_1$ (mm) of the alloy ribbon after the processing by using the equation, processing ratio $dh=((h_0-h_1)/h_0)\times 100$. The processing ratio dh (%) is preferably 0.1% or more and more preferably 1.0% or more. The processing ratio dh (%) is preferably 8.0% or less and more preferably 6.0% or less. During this process, the ribbon is preferably pressure-deformed at a low processing velocity so that the processing velocity ds/dt determined by dividing the processing ratio achieved by the contact-type heating element with the time from onset of the pressure deformation to the end of the deformation (pressing time) is $10^{-5}$/s or more and $10^{-2}$/s or less. Hot rolls described above are preferably used as the contact-type heating element since pressure-deformation can be easily conducted at a low processing velocity. When the heating rolls are used, pressure deformation is also preferably conducted at a low processing velocity so that the processing velocity ds/dt per roll pair is $10^{-5}$/s or more and $10^{-2}$/s or less. In heating the alloy ribbon by the contact-type heating element while applying pressure, the pressing force may be empirically determined to achieve a particular processing ratio depending on the heating temperature and heating time. Note that heating without applying pressure may mean that heating is conducted at a zero pressing force. Alternatively, it may mean that heating is conducted at a pressing force that does not yield deformation or that yields a reduction of less than 0.01%. The pressing force that does not yield deformation may be empirically determined by adjusting the pressing force so that the variation in the direction in which the intermediate phase is generated can be suppressed. For example, the pressing force may be set to larger than 1/100 but less than ½ of the elastic limit of the heated alloy.

The age-hardening step is a step that follows the preliminary-state-generating step and is a step in which the alloy in the preliminary state is heated and cooled to induce precipitation of the intermediate phase. In the age-hardening step, the strength of the alloy can be further increased. The heating temperature, cooling temperature, heating rate, and cooling rate in the age-hardening step may be empirically determined on the basis of the alloy used. The first temperature and the second temperature in the preliminary-state-generating step may each be set to a transformation-related temperature obtained by DSC by heating the alloy at a heating rate determined on the basis of the heating rate during heating in the age-hardening step. In this manner, the results of the age-hardening step can be made closer to the DSC results and first and second temperatures useful in actual production processes can be determined.

Figure 2:
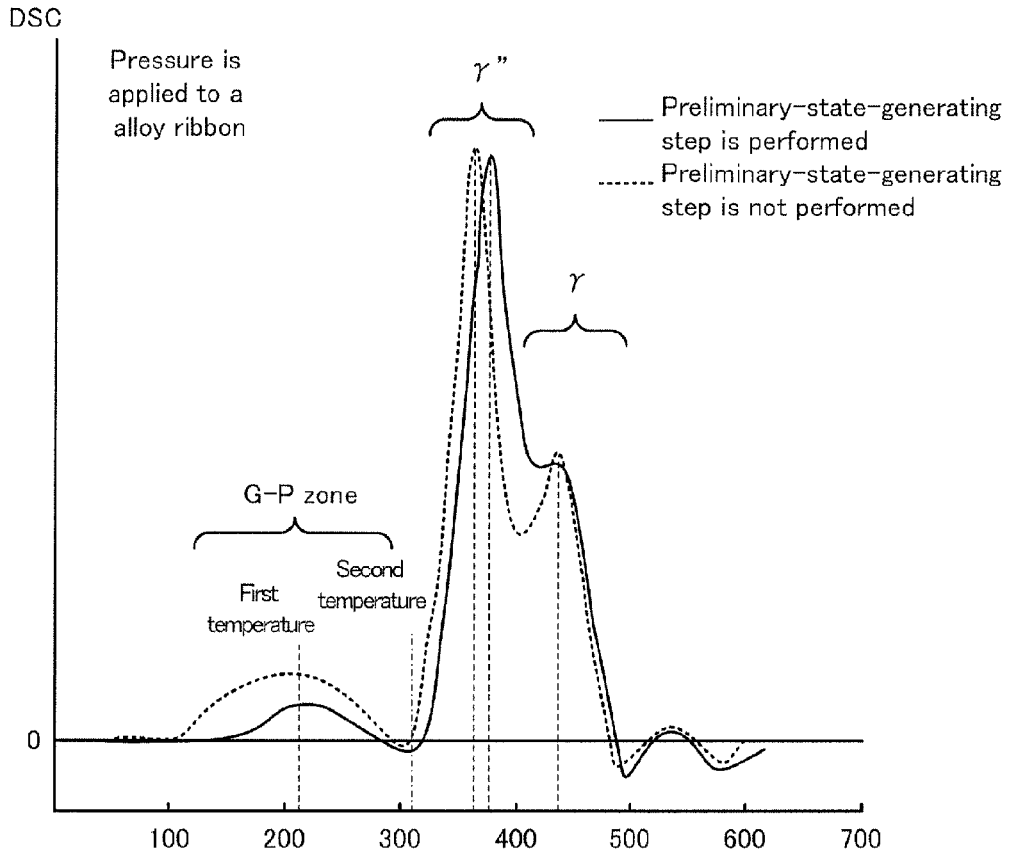
FIG. 2 is a conceptual graph of results obtained by DSC after a preliminary-state-generating step is performed while applying pressure to a Cu—Be alloy ribbon.
Figure 3:
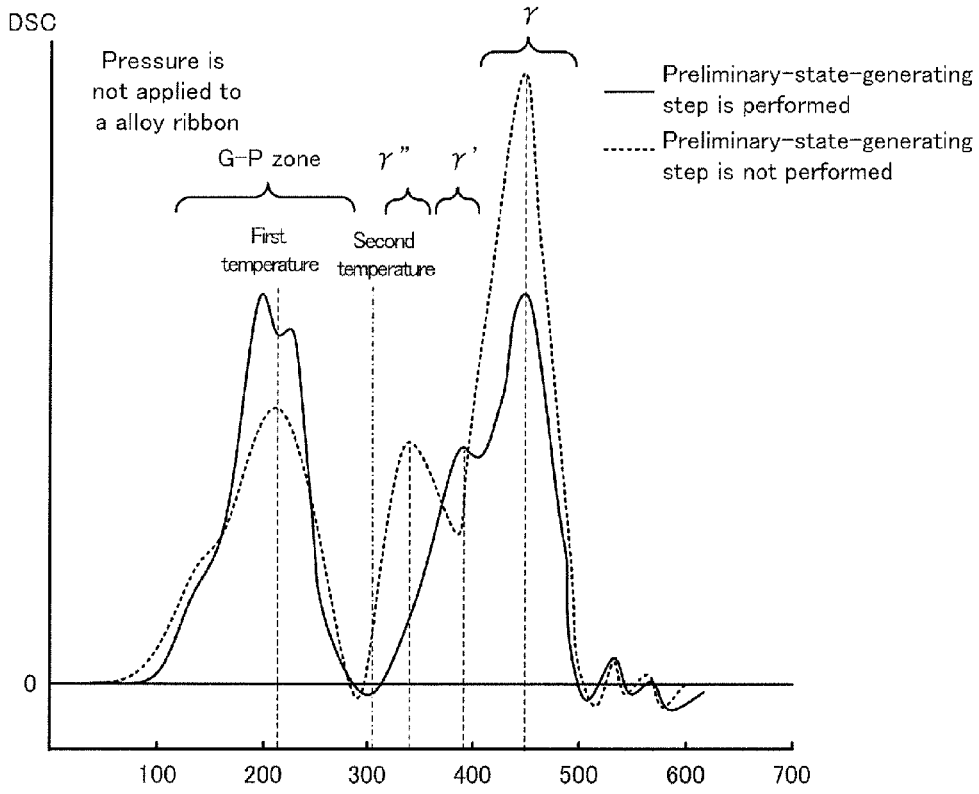
FIG. 3 is a conceptual graph of results obtained by DSC after a preliminary-state-generating step is carried out without applying pressure to a Cu—Be alloy ribbon.

A specific example of the preliminary-state-generating step will now be described by using a Cu—Be alloy. FIG. 2 is a conceptual graph of results obtained by DSC after the preliminary-state-generating step is performed while applying pressure to a Cu—Be alloy ribbon and FIG. 3 is a conceptual graph of results obtained by DSC after the preliminary-state-generating step is carried out without applying pressure to the Cu—Be alloy ribbon. In FIGS. 2 and 3, the DSC results obtained without carrying out the preliminary-state-generating step are also shown. A solution treatment of a Cu—Be alloy gives an α phase in which supersaturated Be is dissolved in Cu. When the α phase is subjected to an age-hardening treatment at a particular age-hardening temperature, a γ phase precipitates. During the course of precipitation of the γ phase, transformation occurs in the order of the G-P zone, the γ phase, the γ' phase, and then the γ phase. In other words, multiple-step transformation occurs with temperature. In Cu—Be alloys, the G-P zone, the γ" phase, or the γ' phase may be assumed to be the intermediate phase and the γ phase may be assumed to be unneeded phase. As shown in FIGS. 2 and 3, as the temperature is increased, a Cu—Be alloy undergoes a first transformation in which the G-P zone precipitates, a second transformation in which the γ" phase precipitates, a third transformation in which the γ' phase precipitates, and a fourth transformation in which the γ phase precipitates. In the case where this Cu—Be alloy is used, the precipitation peak temperature in the G-P zone and the temperature at the rising edge of the precipitation peak of the γ" phase rises determined by DSC may be respectively assumed to be the first temperature and the second temperature in the preliminary-state-generating step. The preliminary-state-generating temperature region may be set to 230° C. or more and 290° C. or less, which is a temperature region higher than the first temperature and lower than the second temperature. In this manner, larger amounts of intermediate phases can be precipitated in the age-hardening step. As shown in FIGS. 2 and 3, the DSC results of Cu—Be alloy ribbons change depending on whether the alloy is pressed in the preliminary-state-generating step or not. For example, as shown in FIG. 2, in the case where the alloy is pressed in the preliminary-state-generating step, heating is conducted while introducing strains. Thus, the nuclei of the G-P zone are preferably already precipitated in the preliminary state. In this manner, extensive initial precipitation of intermediate phases (G-P zone, γ" phase, and γ' phase) presumably occur after the age-hardening step, thereby suppressing precipitation of the γ phase. Referring now to FIG. 3, in the case where the alloy is not pressed in the preliminary-state-generating step, the solid solubility is preferably high. In this manner, the initial precipitation of intermediate phases (G-P zone, γ" phase, and γ' phase) is presumably enhanced, thereby suppressing precipitation of the γ phase is suppressed after the age-hardening step. As such, the first and second temperatures in the preliminary-state-generating step can be determined and the preliminary-state-generating temperature region can be determined based on the DSC. The preliminary-state-generating temperature region is preferably 230° C. or more and 290° C. or less for Cu—Be alloys, 400° C. or more and 500° C. or less for Cu—Ni—Si alloys, 350° C. or more and 500° C. or less for Cu—Ti alloys, and 350° C. or more and 550° C. or less for Cu—Cr—Zr alloys, for example. The temperature region is preferably 100° C. or more and 200° C. or less for 6061 aluminum alloys. The temperature region is preferably 300° C. or more and 400° C. or less for SUS 304 alloys.

Figure 4:
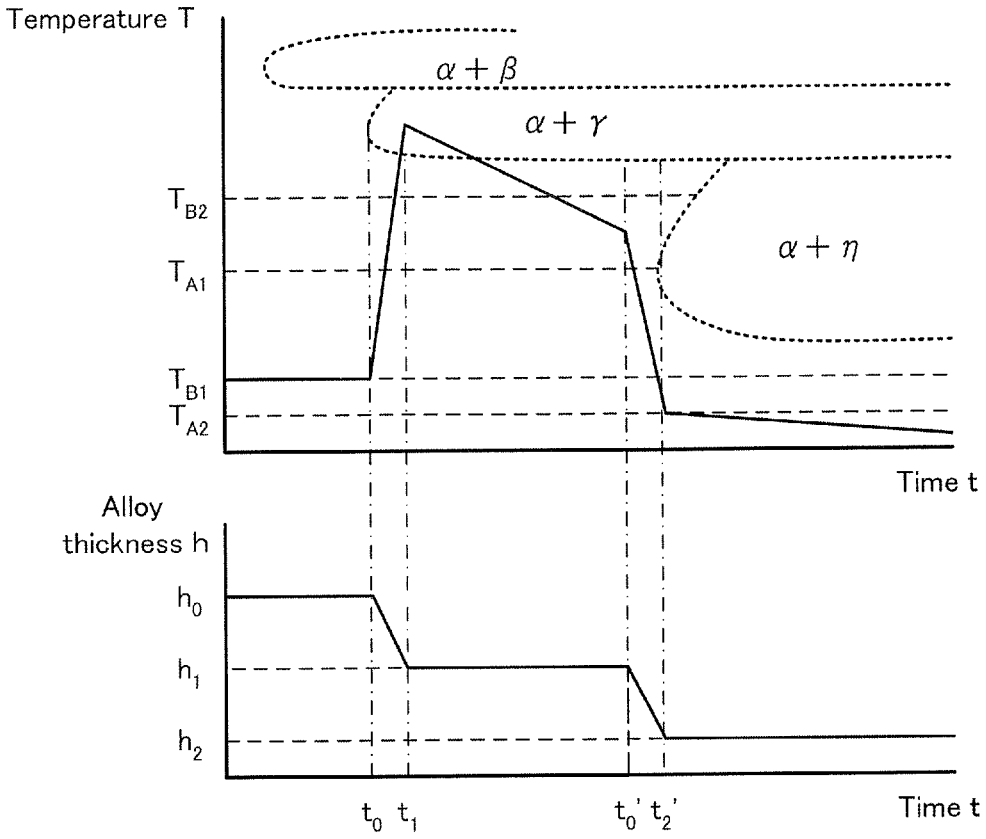
FIG. 4 is a conceptual graph showing an example of a heat pattern of the heat treatment method of the present invention.

The concept of the preliminary-state-generating step and the age-hardening step is described next. FIG. 4 shows an example of a heat pattern of the heat treatment method of the present invention. The upper part of FIG. 4 shows a heat pattern in a solid line, and phase transformation preliminary state curves related to transformations of the α phase to the β, γ, and η phases are shown by broken lines. The phase transformation preliminary state curves refer to curves each of which is empirically obtained and indicates a range of the temperature and time of treating the ribbon alloy in the preliminary-state-generating step so that larger amounts of intermediate phases are obtained in the subsequent age-hardening step. A phase transformation preliminary state curve can be empirically determined based on the relationship obtained by determining the relationship between the amount of intermediate phases generated by conducing an age-hardening step after treating an alloy ribbon for a particular length of time at a particular heating rate within a particular temperature range, and the heating rate, the treatment time, and the treatment temperature of this preliminary-state-generating step. In the example shown in FIG. 4, when an alloy ribbon is heat-treated so as to draw a heat pattern indicated by the solid line, a transformation related to the γ phase occurs in the subsequent age-hardening treatment and larger amounts of intermediate phases are generated. Accordingly, the heat treatment is preferably controlled so that the temperature reaches a particular temperature by crossing the phase transformation preliminary state curve related to precipitation of the γ phase without intersecting the phase transformation preliminary state curves of the β phase and the η phase and retained within the phase transformation preliminary state curve for, for example, 0.01 sec or more and 3.0 sec or less. As a result, precipitation of unneeded phases can be further suppressed. Such a retention may accompany an increase or decrease in temperature. The heating rate during crossing of the phase transformation preliminary state curve is not particularly limited but is preferably 70° C./sec or more. Because of such rapid heating, the nuclei of the intermediate phases that occur before reaching perfect phase transformation can be instantaneously formed and immobilized, and occurrence of the intermediate phases can be stayed at a desired stage. Moreover, reaching the perfect phase transformation can be suppressed even when a heat treatment is subsequently conducted. Note that in FIG. 4, the instance where quenching is conducted without intersecting the phase transformation preliminary state curve of the η phase is shown. Such quenching may be, for example, performed by using a contact-type cooling member (such as cooling rolls) having a cooling mechanism. The lower part of FIG. 4 shows an example of changes in thickness of the ribbon when pressure is applied at the same time with the heat treatment indicated in the upper part of FIG. 4. As shown in these graphs, pressure may be applied at the same time as heating and cooling.

Figure 5:
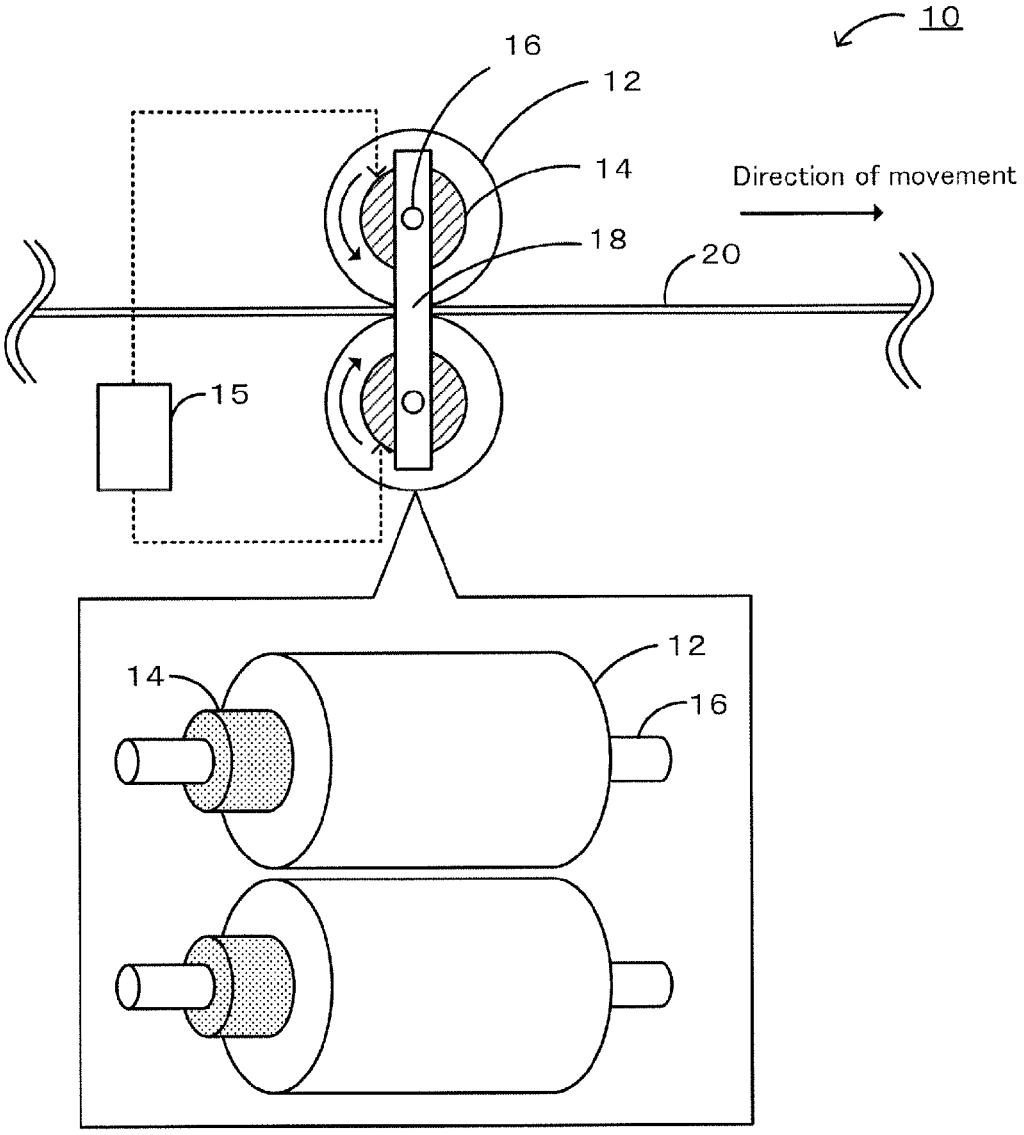
FIG. 5 is a schematic diagram showing one example of a heat treatment apparatus of the present invention.

A heat treatment apparatus used in implementing the heat treatment method of the present invention will now be described. A heat treatment apparatus of the present invention is a heat treatment apparatus that heat-treats an alloy that undergoes multiple-step transformation with temperature and that includes a contact-type heating element that heats the alloy by making contact and a controller that controls the contact-type heating element to a particular temperature within a preliminary-state-generating temperature region determined on the basis of a first temperature related to a particular first transformation of the alloy and a second temperature, which is higher than the first temperature, related to a particular second transformation of the alloy, so that the contact-type heating element comes into contact with the alloy for 0.01 sec or more and 3.0 sec or less. In this heat treatment apparatus, the contact-type heating element may be a pair of heating rolls having a heating mechanism and sandwiching the alloy. FIG. 5 is a structural diagram showing one example of a heat treatment apparatus 10 of the present invention. The heat treatment apparatus 10 includes heating rolls 12 that serve as a contact-type heating element that heats the alloy by making contact with the alloy and a controller 15 that controls the contact time between the heating rolls 12 and an alloy ribbon 20 and the temperature of the heating rolls 12. When an alloy is heated with a contact-type heating element, instantaneous heating is possible compared to when an alloy is heated without making contact such as in a heating furnace or the like, rendering it easier to control the microstructure. The heating rolls 12 are each equipped with a built-in heater 14 serving as a heating mechanism. The heater 14 is controlled by the controller 15 so that the surface temperature of the heating rolls 12 is at a particular temperature within in the preliminary-state-generating temperature region. The heating rolls 12 are each rotatably supported by a shaft 16 and form a pair by sandwiching the alloy ribbon 20. The heat treatment apparatus 10 is configured to press the alloy ribbon 20 by pressing the paired heating rolls 12 with a pressing mechanism 18. Incorporation of the pressing mechanism 18 not only makes rolling possible but also facilitates control of heat-treatment conditions by changing the contact area or contact state between the contact-type heating element and the alloy ribbon. A moving mechanism that can move the contact-type heating element in a direction parallel to the pressing direction of the pressing mechanism may be provided instead of the pressing mechanism 18. The moving mechanism may be, for example, configured to move the heating rolls 12 in vertical directions with respect to the path of the alloy ribbon 20.

The heating rolls 12 are connected to a motor not shown in the drawing. The motor is controlled by the controller 15 so that the tangential velocity of rotation of the heating rolls 12 is coincident with the traveling speed of the alloy ribbon 20. In this manner, the shape failures, scratches in surfaces of the alloy ribbon 20, etc., caused by obstruction of movement of the alloy ribbon 20 can be suppressed. The paired heating rolls 12 are equipped with the pressing mechanism 18 for correcting the flatness of the alloy ribbon 20. The pressing mechanism 18 includes supporting members respectively provided to two ends of each shaft 16 while allowing the shafts 16 to rotate and move in vertical directions and coil springs respectively provided to two ends of each shaft 16 so as to press the shafts 16 toward the alloy ribbon 20. When such a pressing mechanism 18 is provided, it becomes easier to simultaneously conduct heat treatment and pressing treatment on the alloy ribbon 20.

The controller 15 controls the heater 14 to heat the alloy ribbon in contact with the heating rolls 12 to a temperature within the preliminary-state-generating temperature region in the preliminary-state-generating step of the above-described heat treatment method and, at the same time, controls the motor not shown in the drawing to rotate.

According to the heat treatment method and the heat treatment apparatus described above, the alloy can be rapidly heated and delicate temperature control is possible since a contact-type heating element is used. Since the nuclei of the intermediate phases before reaching perfect phase transformation can be instantaneously formed and solidified, the intermediate phases can be stayed at a desired stage and desired variants of intermediate phase generation can be obtained.

The present invention is by no means limited to the embodiments described above and can naturally be implemented in various forms without departing from the technical scope of the present invention.

Although the heat treatment method of the embodiment described above includes steps in addition to the preliminary-state-generating step, it is sufficient if the method includes at least the preliminary-state-generating step. In other words, the heat treatment method of the present invention may include only the preliminary-state-generating step. For example, a raw material subjected to a solution treatment step may be purchased and the preliminary-state-generating step may be conducted on this purchased material. Alternatively, an alloy subjected to the steps up to the preliminary-state-generating step may be provided as a product so that a user can perform an age-hardening step.

Figure 6:
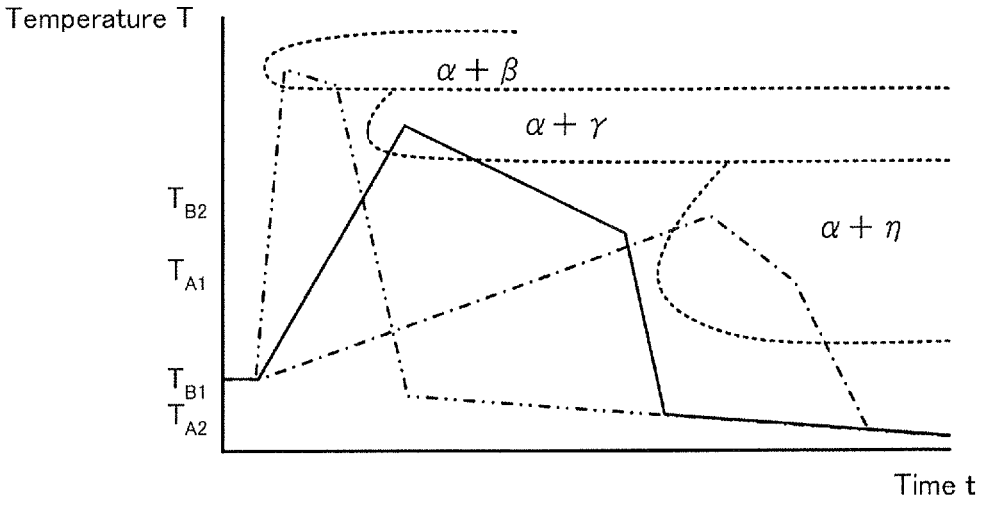
FIG. 6 is a graph showing a preliminary-state-generating step carried out in multiple steps.

Although the alloy ribbon is subjected to the preliminary-state-generating process so that the alloy ribbon is within the preliminary-state-generating temperature region related to the $\alpha$ phase and the $\gamma$ phase in the embodiment described above (FIG. 4), the preliminary-state-generating step may be carried out in multiple steps as shown in FIG. 6. FIG. 6 is a graph showing the preliminary-state-generating step carried out in multiple steps. Referring to FIG. 6, for example, the alloy ribbon is subjected to a preliminary-state-generating treatment so that the temperature is within the preliminary-state-generating temperature region related to the $\alpha$ phase and the $\eta$ phase (dot-dash line), and then to another preliminary-state-generating treatment so that the temperature is within the preliminary-state-generating temperature region related to the $\alpha$ phase and the $\gamma$ phase (solid line), and then to yet another preliminary-state-generating treatment so that the temperature is within the preliminary-state-generating temperature region related to the $\alpha$ phase and the $\beta$ phase (dot-dot-dash line). Since nuclei of the respective phases can be formed as such, this method can be applied to controlling precipitation of the respective phases.

Figure 7:
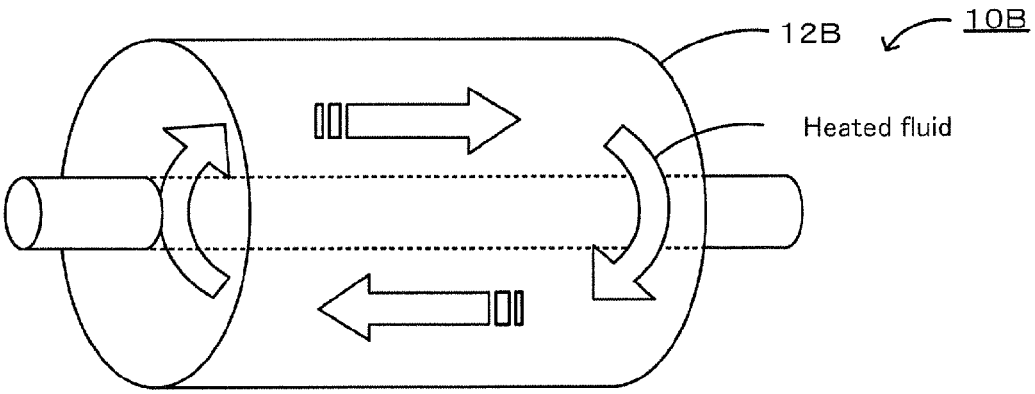
FIG. 7 is a schematic diagram showing another example of a heat treatment apparatus of the present invention.
Figure 8:
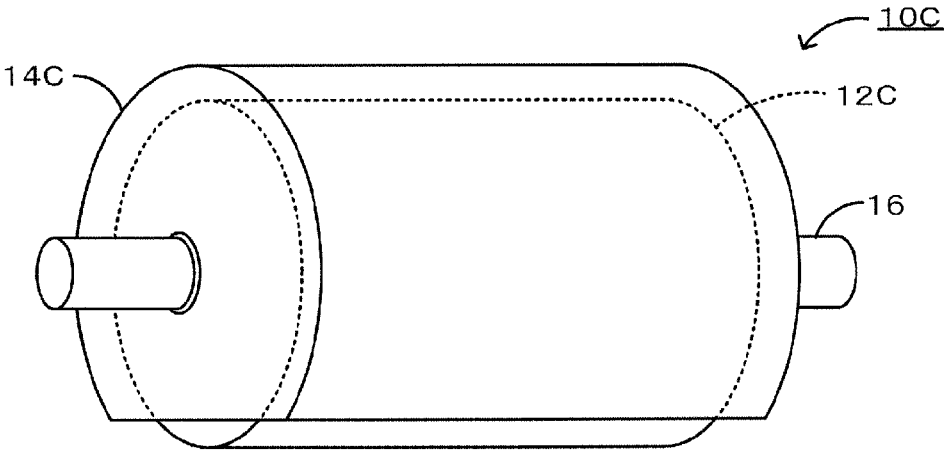
FIG. 8 is a schematic diagram showing yet another example of a heat treatment apparatus of the present invention.

Although the heat treatment apparatus 10 is equipped with the heater 14 as the heating mechanism in the above-described embodiment, the heat treatment apparatus 10 is not limited to this. For example, a shown in FIG. 7, a heat-treatment apparatus 10B equipped with a heating roll 12B in which a heated fluid moves inside the roll may be used, or, as shown in FIG. 8, a heat-treatment apparatus 100 equipped with a heater 14C irradiating and heating a surface of the heating roll 12C from outside the heating roll 12C may be used. The alloy can be heated also by using these heating rolls. The same applies when the contact-type heating element is not a heating roll.

Figure 9:
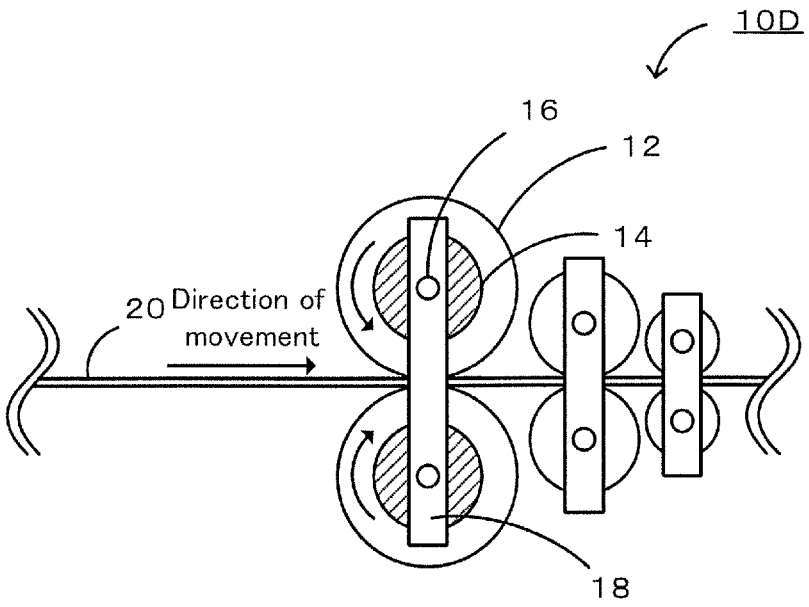
FIG. 9 is a schematic diagram showing still another example of a heat treatment apparatus of the present invention.

Although a pair of heating rolls 12 is used as the contact-type heating element in the above-described embodiment, a heat treatment apparatus 10D equipped with a plurality of pairs of rolls may be used as shown in FIG. 9. More delicate temperature control is possible when a plurality of pairs of heating rolls are used to heat the alloy ribbon since the temperature can be changed from one roll pair to another. In this case, it is preferable to conduct a treatment in accordance with a temperature-time curve by which the surface temperatures of adjacent rolls are different from one another by 50° C. or more and the time taken to pass the roll-to-roll midpoint (time between one treatment and the next treatment) is 5 sec or less. In the case where a second pair of metal rolls or more pairs of metal rolls are used, the alloy ribbon may be pressed or may not be pressed by the heating rolls. In addition to the heating rolls, cooling rolls having a cooling mechanism may be provided. It then becomes possible to quench the alloy ribbon and control the temperature more delicately. Although the paired rolls are arranged in a vertical direction, the direction in which the paired rolls are arranged is not particularly limited. Alternatively, a right roll and a left roll may form a pair. Yet alternatively, a roll may be provided only on one side. Although the heating rolls 12 in the aforementioned embodiment is controlled so that the tangential velocity of the rotation is coincident with the traveling velocity of the alloy ribbon 20, the heating rolls 12 are not limited to this. The alloy ribbon can be rapidly heated by using such things.

Figure 10:
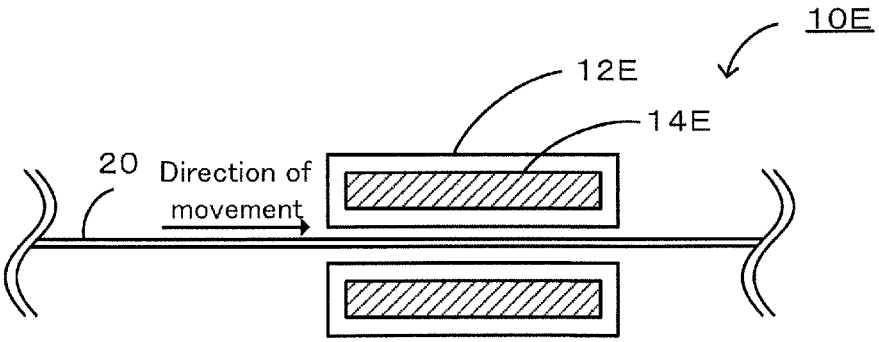
FIG. 10 is a schematic diagram showing still another example of a heat treatment apparatus of the present invention.

In the aforementioned embodiment, the heating rolls 12 are used as the contact-type heating element and continuously make contact with the alloy ribbon 20. However, this is not a limitation. For example, as shown in FIG. 10, a heat treatment apparatus 10E equipped with a block-shaped contact-type heating element 12E including a heater 14E may be used and the heat-treatment apparatus 10E may be intermittently brought into contact with the alloy ribbon 20 while intermittently conveying the alloy ribbon 20.

Although the paired heating rolls 12 are equipped with the pressing mechanism 18 in the aforementioned embodiment, the pressing mechanism 18 may be omitted. In this case, the heating rolls 12 may be rotatably immobilized. The alloy ribbon can also be rapidly heated in this manner.

Although the pressing mechanism 18 has coil springs in the aforementioned embodiment, at least one of an elastic material, hydraulic pressure, gas pressure, electromagnetic force, a pressure motor, a gear, and a screw may be used instead to control the pressing force. The pressing mechanism 18 may be provided to one of the heating rolls 12 and the other heating roll 12 may be fixed. Both the heating rolls 12 may be separately equipped with pressing mechanisms 18 or may share a common pressing mechanism 18.

The heating rolls 12 in the aforementioned embodiment are made of stainless steel but this is not a limitation. Various materials may be used for the heating rolls 12 but metals are preferable. This is because metals have high thermal conductivity and are suitable for rapid heating. Metals are also preferred from the viewpoint of smooth surface. From the viewpoints of corrosion resistance, strength, and thermal strength, stainless steel is preferable. From the viewpoint of further increasing the heating rate, cupronickel having high thermal conductivity is preferably used in the heating rolls 12. The heating rolls 12 may each have a layer in a surface, the layer 10 being formed of at least one of chromium, zirconium, a chromium compound, and a zirconium compound. When such coating having low reactivity to copper is applied, adhesion of copper to the rolls in making a copper alloy ribbon can be suppressed and transfer of the adhered copper to the alloy ribbon 20 can be suppressed. This layer preferably has a thickness of 2 μm or more and 120 μm or less, more preferably 3 μm or more and 100 μm or less, and most preferably 5 μm or more and 97 μm or less. This is because at a thickness of 2 μm or more, separation is suppressed and a uniform layer can be formed. At a thickness of 120 μm or less, the alloy ribbon 20 can be rapidly heated without decreasing the thermal conductivity of the heating rolls 12.

Although a method for producing a precipitation-hardening type alloy ribbon is described in the aforementioned embodiment, this is not a limitation. For example, a bar may be produced instead of a ribbon.

EXAMPLES

Next, specific examples of preparing alloy ribbons through the heat treatment method of the present invention are described as Examples.

Example 1

A Cu—Be—Co alloy containing 1.90% by mass of Be, 0.20% by mass of Co, and the balance being Cu was melted, casted, cold-rolled, and solution-treated to prepare a crude alloy ribbon having a width of 50 mm and a thickness of 0.27 mm. This composition was preliminarily determined by chemical analysis and the thickness was measured with a micrometer. The solution treatment was performed as follows. First, a cold-rolled crude alloy was heated to 800° C. in a nitrogen atmosphere in a heating chamber maintained at 0.15 MPa. This temperature is the temperature indicated by a thermocouple installed near an end portion of the heating chamber. Then the heated crude alloy ribbon was continuously discharged to a cooling chamber from an outlet connected to the cooling chamber and cooled to 25° C. with a pair of cooling rolls in the cooling chamber. The cooling rate was 640° C./s. The cooling rolls were made of stainless steel (SUS316) and a surface of the outer cylinder was plated with hard Cr having a thickness of 5 μm. During cooling, the tangential velocity of the cooling rolls was adjusted to be coincident with the travelling velocity of the ribbon.

The resulting alloy ribbon kept at 25° C. was subjected to the preliminary-state-generating step of the present invention. In the preliminary-state-generating step, a pair of heating plates (6.0 cm×6.0 cm) symmetrically arranged in a vertical direction was used to heat-treat the alloy ribbon. The surface temperatures of the heating plates were 231° C. This temperature was measured with a contact-type thermometer. The contact time between the heating plates and the alloy ribbon was 1.0 sec and the heating rate was 206° C./sec. Rolling was also performed with the heating plates at the same time with heating, where the processing ratio dh (%) was 5.0%. The processing ratio dh (%) was determined by measuring the thickness $h_0$ (mm) of the ribbon before processing and the thickness $h_1$ (mm) of the ribbon after the processing with a micrometer and by using the equation, $dh=((h_0-h_1)/h_0)\times 100$. The heating plates were composed of stainless steel and the outer surfaces were plated with hard chromium having a thickness of 5 μm. The heated alloy ribbon was air-cooled after being brought into contact with the heating plates. The resulting alloy ribbon in which a preliminary state was generated was used as an alloy ribbon of Example 1.

Examples 2 to 6

An alloy ribbon of Example 2 was obtained by the same steps as those in Example 1 except that the contact time with the heating plates was 2.9 sec and the heating rate was 71° C./sec. An alloy ribbon of Example 3 was obtained by the same steps as those in Example 1 except that the surface temperatures of the heating plates were 290° C., the contact time with the heating plates was 2.9 sec, and the heating rate was 91° C./sec. An alloy ribbon of Example 4 was obtained by the same steps as those in Example 1 except that the surface temperatures of the heating plates were 260° C., the contact time with the heating plates was 0.1 sec, and the heating rate was 2350° C./sec. An alloy ribbon of Example 5 was obtained by the same steps as those in Example 1 except that the surface temperatures of the heating plates were 260° C., the contact time with the heating plates was 1.0 sec, and the heating rate was 235° C./sec. An alloy ribbon of Example 6 was obtained by the same steps as those in Example 1 except that the surface temperatures of the heating plates were 260° C., the contact time with the heating plates was 2.9 sec, and the heating rate was 81° C./sec.

Examples 7 and 8

An alloy ribbon of Example 7 was obtained by the same steps as those in Example 5 except that the processing ratio was 3.2%. An alloy ribbon of Example 8 was obtained by the same steps as those in Example 5 except that the processing ratio was 9.9%.

Example 9

An alloy ribbon of Example 9 was obtained by the same steps as those in Example 1 except that, in the solution treatment, cooling was performed to 93° C., and the resulting alloy ribbon kept at 93° C. was heat-treated so that the surface temperatures of the heating plates were 260° C., the contact time with the heating plates was 1.0 sec, and the heating rate was 167° C./sec.

Examples 10 and 11

An alloy ribbon of Example 10 was obtained by the same steps as those in Example 1 except that a Cu—Ni—Si alloy containing 2.40% by mass of Ni, 0.60% by mass of Si, and the balance being Cu was used, the surface temperatures of the heating plates were 400° C., the contact time with the heating plates was 1.0 sec, the heating rate was 375° C./sec, and the processing ratio was 3.2%. An alloy ribbon of Example 11 was obtained by the same steps as those in Example 10 except that the surface temperatures of the heating plates were 450° C., the contact time with the heating plates was 1.0 sec, the heating rate was 425° C./sec, and the processing ratio was 5.0%.

Examples 12 and 13

An alloy ribbon of Example 12 was obtained by the same steps as those in Example 1 except that a Cu—Ti alloy containing 3.0% by mass of Ti and the balance being Cu was used, the surface temperatures of the heating plates were 350° C., the contact time with the heating plates was 1.0 sec, and the heating rate was 325° C./sec. An alloy ribbon of Example 13 was obtained by the same steps as those in Example 12 except that the surface temperatures of the heating plates were 450° C., the contact time with the heating plates was 1.0 sec, the heating rate was 425° C./sec, and the processing ratio was 3.2%.

Examples 14 and 15

An alloy ribbon of Example 14 was obtained by the same steps as those in Example 1 except that a Cu—Cr—Zr alloy containing 0.3% by mass of Cr, 0.12% by mass of Zr, and the balance being Cu was used, the surface temperatures of the heating plates were 350° C., the contact time with the heating plates was 1.0 sec, the heating rate was 325° C., and the processing ratio was 3.2%. An alloy ribbon of Example 15 was obtained by the same steps as those in Example 14 except that the surface temperatures of the heating plates were 450° C., the contact time with the heating plates was 1.0 sec, the heating rate was 425° C./sec, and the processing ratio was 5.0%.

Example 16

An alloy ribbon of Example 16 was obtained by the same steps as those in Example 1 except that a 6061 aluminum alloy containing 0.65% by mass of Mg, 0.35% by mass of Si, and the balance being Al was used, the surface temperatures of the heating plates were 150° C., the contact time with the heating plates was 1.0 sec, and the heating rate was 125° C./sec.

Example 17

An alloy ribbon of Example 17 was obtained by the same steps as those in Example 1 except that a SUS304 alloy containing 18.3% by mass of Cr, 8.6% by mass of Ni, and the balance being Fe was used, the surface temperatures of the heating plates were 400° C., the contact time with the heating plates was 1.0 sec, and the heating rate was 375° C./sec.

Comparative Examples 1 to 7

An alloy ribbon of Comparative Example 1 was obtained by the same steps as those in Example 1 except that the surface temperatures of the heating plates were 227° C., the contact time with the heating plates was 1.0 sec, and the heating rate was 202° C./sec. An alloy ribbon of Comparative Example 2 was obtained by the same steps as those in Comparative Example 1 except that the processing ratio was 14%. An alloy ribbon of Comparative Example 3 was obtained by the same steps as those in Example 1 except that the surface temperatures of the heating plates were 227° C., the contact time with the heating plates was 3.2 sec, and the heating rate was 63° C./sec. An alloy ribbon of Comparative Example 4 was obtained by the same steps as those in Example 1 except that the surface temperatures of the heating plates were 310° C., the contact time with the heating plates was 1.0 sec, and the heating rate was 285° C./sec. An alloy ribbon of Comparative Example 5 was obtained by the same steps as those in Example 1 except that the surface temperatures of the heating plates were 25° C., the contact time with the heating plates was 2.9 sec, and the heating rate was 0° C./sec. An alloy ribbon of Comparative Example 6 was obtained by the same steps as those in Example 1 except that cooling in the solution treatment was performed to 107° C., and the resulting alloy ribbon kept at 107° C. was heated so that the surface temperatures of the heating plates were 260° C., the contact time with the heating plates was 1.0 sec, and the heating rate was 153° C./sec. An alloy ribbon of Comparative Example 7 was obtained by the same steps as those in Example 1 except that the surface temperatures of the heating plates were 190° C., the contact time with the heating plates was 1.0 sec, and the heating rate was 165° C./sec.

Comparative Example 8

In Comparative Example 8, a Cu—Ni—Si alloy was used. An alloy ribbon of Comparative Example 8 was obtained by the same step as those in Example 11 except that the surface temperatures of the heating plates were 350° C., the contact time with the heating plates was 1.0 sec, and the heating rate was 325° C./sec.

Comparative Example 9

In Comparative Example 9, a Cu—Ti alloy was used. An alloy ribbon of Comparative Example 9 was obtained by the same step as those in Example 12 except that the surface temperatures of the heating plates were 300° C., the contact time with the heating plates was 1.0 sec, and the heating rate was 275° C./sec.

Comparative Example 10

In Comparative Example 10, a Cu—Cr—Zr alloy was used. An alloy ribbon of Comparative Example 10 was obtained by the same step as those in Example 15 except that the surface temperatures of the heating plates were 300° C., the contact time with the heating plates was 1.0 sec, and the heating rate was 275° C./sec.

Comparative Example 11

In Comparative Example 11, a 6061 aluminum alloy was used. An alloy ribbon of Comparative Example 11 was obtained by the same step as those in Example 16 except that the surface temperatures of the heating plates were 210° C., the contact time with the heating plates was 1.0 sec, and the heating rate was 185° C./sec.

Comparative Example 12

In Comparative Example 12, a SUS304 alloy was used. An alloy ribbon of Comparative Example 12 was obtained by the same step as those in Example 17 except that the surface temperatures of the heating plates were 470° C., the contact time with the heating plates was 1.0 sec, and the heating rate was 445° C./sec.

(DSC Evaluation)

Figure 11:
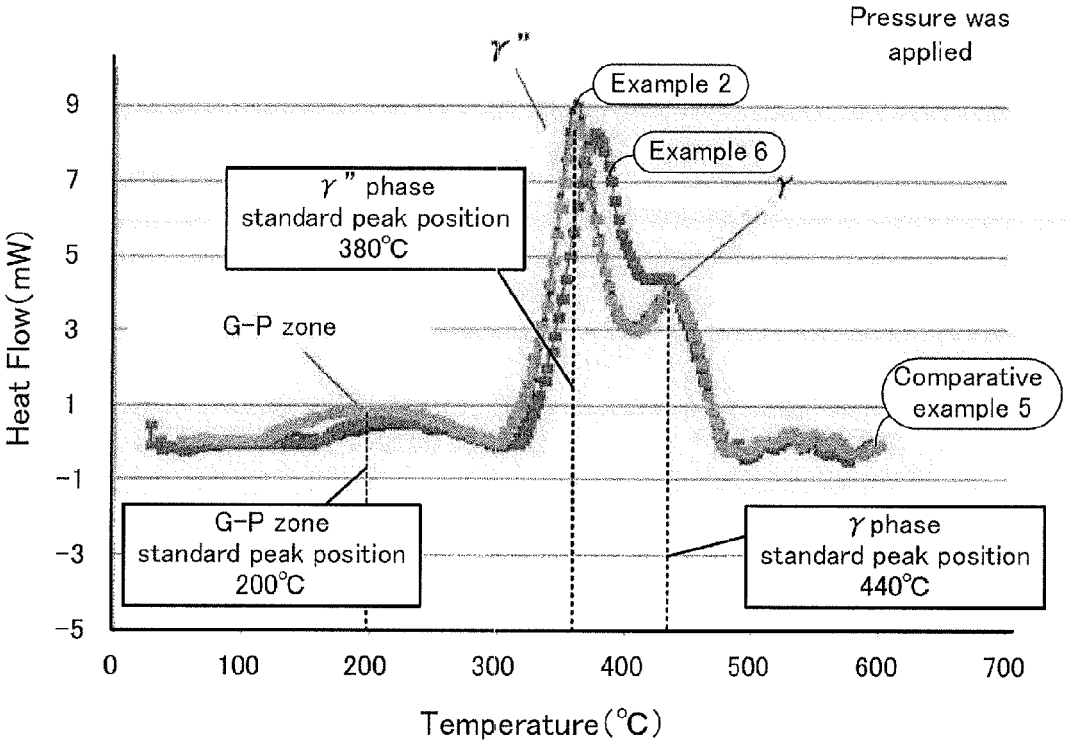
FIG. 11 is a graph showing the DSC results of Examples in which pressure was applied during heating.

The alloy ribbons of Examples 1 to 17 and Comparative Examples 1 to 12 were subjected to differential scanning calorimetry (DSC). FIG. 11 is a graph showing the DSC results of Examples 2 and 6 and Comparative Example 5. In FIG. 11, the standard peak positions of the G-P zone, the γ" phase, and the γ phase are also indicated. The state of phase precipitation was evaluated on the basis of the DSC results. Table 1 is a table that shows the evaluation results of Examples 1 to 17 and Comparative Examples 1 to 12. In Table 1, production conditions for the alloy ribbons are indicated in addition to the evaluation results. Table 2 shows the evaluation standards used in Table 1. In the evaluation standard, the figures under items other than the deviations of peak positions are cumulative intensities of the respective precipitation peaks detected by DSC. Table 3 shows the details of the evaluation for Examples 2 and 3 and Comparative Example 5. In Examples 1 to 17, the initial precipitation phase (G-P zone), the later precipitation phase (γ phase), and the peak positions (deviation from the standard peak positions) were all satisfactory. In contrast, in Comparative Examples 1 to 12, one or more of the initial precipitation phase, the later precipitation phase, and the peak position did not satisfy the evaluation standards. Note that the evaluation standard indicated in Table 2 are the evaluation standards for ribbons that are heated and rolled simultaneously. Since such materials are heated while introducing strains, the G-P zone is preferably already precipitated. Moreover, precipitation of the γ phase after aging is preferably suppressed.

TABLE 1

| | | | Heat condition | | | | DSC evaluation | | |
|---|---|---|---|---|---|---|---|---|---|
| | Material | Material temperature ° C. | Heating plate temperature ° C. | Contact time sec | Heating rate ° C./sec | Processing ratio % | Initial precipitation phase | Later precipitation phase | Peak position |
| Example 1 | Cu—Be alloy | 25 | 231 | 1 | 206 | 5 | ◎ | ○ | ◎ |
| Example 2 | Cu—Be alloy | 25 | 231 | 2.9 | 71 | 5 | ◎ | ○ | ◎ |
| Example 3 | Cu—Be alloy | 25 | 290 | 2.9 | 91 | 5 | ○ | ◎ | ◎ |
| Example 4 | Cu—Be alloy | 25 | 260 | 0.1 | 2350 | 5 | ○ | ◎ | ◎ |
| Example 5 | Cu—Be alloy | 25 | 260 | 1 | 235 | 5 | ◎ | ◎ | ◎ |
| Example 6 | Cu—Be alloy | 25 | 260 | 2.9 | 81 | 5 | ○ | ◎ | ◎ |
| Example 7 | Cu—Be alloy | 25 | 260 | 1 | 235 | 3.2 | ◎ | ◎ | ○ |
| Example 8 | Cu—Be alloy | 25 | 260 | 1 | 235 | 9.9 | ◎ | ◎ | ○ |
| Example 9 | Cu—Be alloy | 93 | 260 | 1 | 167 | 5 | ○ | ○ | ◎ |
| Example 10 | Cu—Ni—Si alloy | 25 | 400 | 1 | 375 | 3.2 | ◎ | ◎ | ○ |
| Example 11 | Cu—Ni—Si alloy | 25 | 450 | 1 | 425 | 5 | ◎ | ◎ | ◎ |
| Example 12 | Cu—Ti alloy | 25 | 350 | 1 | 325 | 5 | ◎ | ◎ | ◎ |
| Example 13 | Cu—Ti alloy | 25 | 450 | 1 | 425 | 3.2 | ◎ | ◎ | ○ |
| Example 14 | Cu—Cr—Zr alloy | 25 | 350 | 1 | 325 | 3.2 | ◎ | ◎ | ○ |
| Example 15 | Cu—Cr—Zr alloy | 25 | 450 | 1 | 425 | 5 | ◎ | ◎ | ◎ |
| Example 16 | 6061Al alloy | 25 | 150 | 1 | 125 | 5 | ◎ | ○ | ◎ |
| Example 17 | SUS304 alloy | 25 | 400 | 1 | 375 | 5 | ◎ | ◎ | ○ |
| Comparative example 1 | Cu—Be alloy | 25 | 227 | 1 | 202 | 5 | Δ | ○ | ◎ |
| Comparative example 2 | Cu—Be alloy | 25 | 227 | 1 | 202 | 14 | ◎ | Δ | Δ |
| Comparative example 3 | Cu—Be alloy | 25 | 227 | 3.2 | 63 | 5 | ○ | Δ | ◎ |
| Comparative example 4 | Cu—Be alloy | 25 | 310 | 1 | 285 | 5 | ◎ | Δ | ◎ |
| Comparative example 5 | Cu—Be alloy | 25 | 25 | 2.9 | 0 | 5 | Δ | ○ | ◎ |
| Comparative example 6 | Cu—Be alloy | 107 | 260 | 1 | 153 | 5 | Δ | ◎ | ◎ |
| Comparative example 7 | Cu—Be alloy | 25 | 190 | 1 | 165 | 5 | Δ | Δ | ◎ |
| Comparative example 8 | Cu—Ni—Si alloy | 25 | 350 | 1 | 325 | 5 | Δ | Δ | ◎ |
| Comparative example 9 | Cu—Ti alloy | 25 | 300 | 1 | 275 | 5 | Δ | ○ | ◎ |
| Comparative example 10 | Cu—Cr—Zr alloy | 25 | 300 | 1 | 275 | 5 | Δ | ◎ | ◎ |
| Comparative example 11 | 6061Al alloy | 25 | 210 | 1 | 185 | 5 | Δ | ◎ | ◎ |
| Comparative example 12 | SUS304 alloy | 25 | 470 | 1 | 445 | 5 | Δ | ◎ | ◎ |

TABLE 2

| | Evaluation standard | | |
|---|---|---|---|
| | ◎ | ○ | Δ |
| G-P zone | 5 or more and less than 16 | 16 or more and less than 26 | 26 or more |
| γ | Less than 71 | 71 or more and less than 76 | 76 or more |
| Deviation of peak position | −5° C. or more and less than 10° C. | 10° C. or more and 15° C. or less | Less than −5° C. or more than 15° C. |

TABLE 3

| | Example 2 231° C. 2.9 sec | | Example 3 290° C. 2.9 sec | | Comparative example 5 25° C. 2.9 sec | |
|---|---|---|---|---|---|---|
| G-P zone | 11 | ◎ | 19 | ○ | 40 | Δ |
| γ" | 160 | | 166 | | 161 | |
| γ | 74 | ○ | 69 | ◎ | 71 | ○ |
| Total amount | 245 | | 254 | | 272 | |

Examples 18 to 22

An alloy ribbon of Example 18 was obtained by the same steps as those in Example 1 except that the contact time with the heating plates was 3.0 sec, the heating rate was 69° C./sec, and the processing ratio was 0%. An alloy ribbon of Example 19 was obtained by the same steps as those in Example 18 except that the surface temperatures of the heating plates were 290° C., the contact time with the heating plates was 3.0 sec, and the heating rate was 88° C./sec. An alloy ribbon of Example 20 was obtained by the same steps as those in Example 18 except that the surface temperatures of the heating plates were 260° C., the contact time with the heating plates was 1.0 sec, and the heating rate was 235° C./sec. An alloy ribbon of Example 21 was obtained by the same steps as those in Example 18 except that the surface temperatures of the heating plates were 260° C., the contact time with the heating plates was 3.0 sec, and the heating rate was 78° C./sec. An alloy ribbon of Example 22 was obtained by the same steps as those in Example 18 except that the cooling in the solution treatment was conducted to 93° C., and the resulting alloy ribbon kept at 93° C. was heated so that the surface temperatures of the heating plates were 260° C., the contact time with the heating plates was 3.0 sec, and the heating rate was 56° C./sec.

Example 23

An alloy ribbon of Example 23 was obtained by the same steps as those in Example 18 except that a Cu—Ni—Si alloy containing 2.40% by mass of Ni, 0.60% by mass of Si, and the balance being Cu was used and heated so that the surface temperatures of the heating plates were 400° C., the contact time with the heating plates was 3.0 sec, and the heating rate was 125° C./sec.

Example 24

An alloy ribbon of Example 24 was obtained by the same steps as those in Example 18 except that a Cu—Ti alloy containing 3.0% by mass of Ti and the balance being Cu was used and heated so that the surface temperatures of the heating plates were 350° C., the contact time with the heating plates was 3.0 sec, and the heating rate was 108° C./sec.

Example 25

An alloy ribbon of Example 25 was obtained by the same steps as those in Example 18 except that a Cu—Cr—Zr alloy containing 0.3% by mass of Cr, 0.12% by mass of Zr, and the balance being Cu was used and heated so that the surface temperatures of the heating plates were 350° C., the contact time with the heating plates was 3.0 sec, and the heating rate was 325° C./sec.

Example 26

An alloy ribbon of Example 26 was obtained by the same steps as those in Example 18 except that a 6061 aluminum alloy containing 0.65% by mass of Mg, 0.35% by mass of Si, and the balance being Al was used and heated so that the surface temperatures of the heating plates were 150° C., the contact time with the heating plates was 3.0 sec, and the heating rate was 125° C./sec.

Example 27

An alloy ribbon of Example 27 was obtained by the same steps as those in Example 18 except that a SUS304 alloy containing 18.3% by mass of Cr, 8.6% by mass of Ni, and the balance being Fe was used and heated so that the surface temperatures of the heating plates were 400° C., the contact time with the heating plates was 3.0 sec, and the heating rate was 375° C./sec.

Comparative Examples 13 and 14

An alloy ribbon of Comparative Example 13 was obtained by the same steps as those in Example 18 except that the surface temperatures of the heating plates were 260° C., the contact time with the heating plates was 3.2 sec, and the heating rate was 73° C./sec. An alloy ribbon of Comparative Example 14 was obtained by the same steps as those in Example 18 except that the surface temperatures of the heating plates were 25° C., the contact time with the heating plates was 3.0 sec, and the heating rate was 0° C./sec.

Comparative Example 15

In Comparative Example 15, a Cu—Ni—Si alloy was used. An alloy ribbon of Comparative Example 15 was obtained by the same step as those in Example 23 except that the surface temperatures of the heating plates were 350° C., the contact time with the heating plates was 3.0 sec, and the heating rate was 108° C./sec.

Comparative Example 16

In Comparative Example 16, a Cu—Ti alloy was used. An alloy ribbon of Comparative Example 16 was obtained by the same step as those in Example 24 except that the surface temperatures of the heating plates were 300° C., the contact time with the heating plates was 3.0 sec, and the heating rate was 92° C./sec.

Comparative Example 17

In Comparative Example 17, a Cu—Cr—Zr alloy was used. An alloy ribbon of Comparative Example 17 was obtained by the same step as those in Example 25 except that the surface temperatures of the heating plates were 300° C., the contact time with the heating plates was 3.0 sec, and the heating rate was 92° C./sec.

Comparative Example 18

In Comparative Example 18, a 6061 aluminum alloy was used. An alloy ribbon of Comparative Example 18 was obtained by the same step as those in Example 26 except that the surface temperatures of the heating plates were 210° C., the contact time with the heating plates was 3.0 sec, and the heating rate was 62° C./sec.

Comparative Example 19

In Comparative Example 19, a SUS304 alloy was used. An alloy ribbon of Comparative Example 19 was obtained by the same step as those in Example 27 except that the surface temperatures of the heating plates were 470° C., the contact time with the heating plates was 3.0 sec, and the heating rate was 148° C./sec.

(DSC Evaluation)

Figure 12:
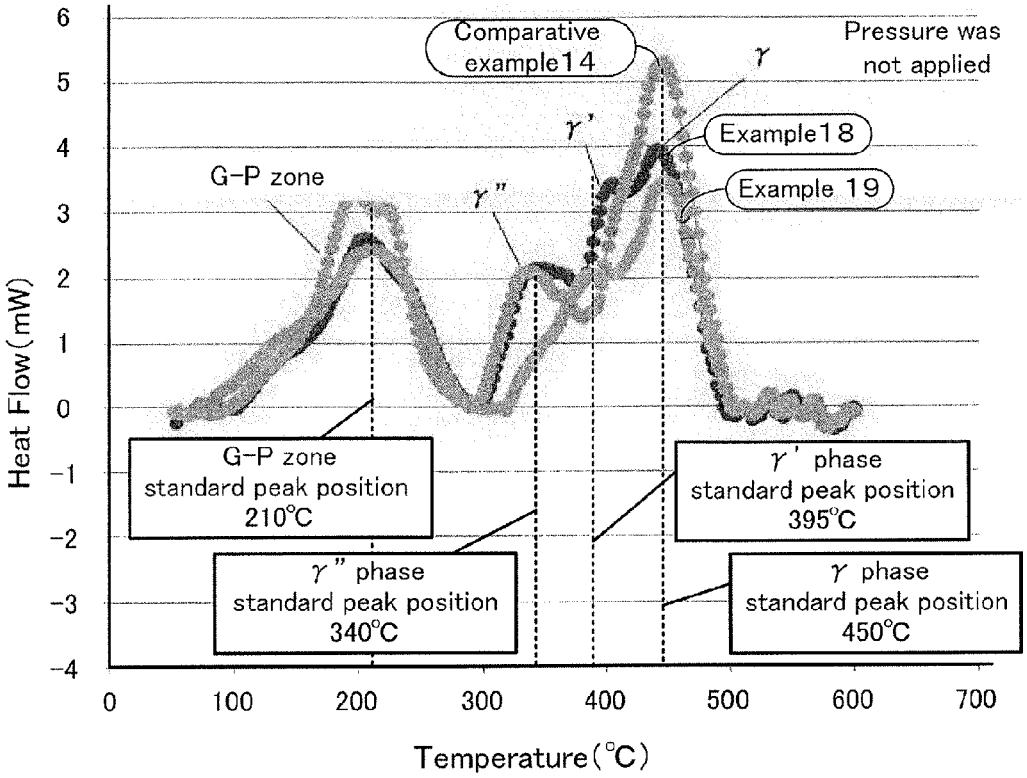
FIG. 12 is a graph showing the DSC results of Examples in which heating was conducted without applying pressure.

The alloy ribbons of Examples 18 to 27 and Comparative Examples 13 to 19 were subjected to DSC. FIG. 12 is a graph showing the DSC results of Examples 18 and 19 and Comparative Example 14. In FIG. 12, the standard peak positions of the G-P zone, the γ phase, the γ' phase, and the γ phase are also indicated. The state of phase precipitation was evaluated on the basis of the DSC results. Table 4 is a table that shows the evaluation results of Examples 18 to 27 and Comparative Examples 13 to 19. In Table 4, production conditions for the alloy ribbons are indicated in addition to the evaluation results. Table 5 shows the evaluation standards used in Table 4. In the evaluation standard, the figures under items other than the deviations of peak positions are cumulative intensities of the respective precipitation peaks detected by DSC. Table 6 shows the details of the evaluation for Examples 18 and 19 and Comparative Example 14. In Examples 18 to 27, the initial precipitation phase (G-P zone), the later precipitation phase (γ phase), and the peak positions (deviation from the standard peak positions) were all satisfactory. In contrast, in Comparative Examples 13 to 19, one or more of the initial precipitation phase, the later precipitation phase, and the peak position did not satisfy the evaluation standards. Note that the evaluation standard indicated in Table 5 are the evaluation standards for ribbons that are heated without rolling. For such materials, the solid solubility is preferably high, the initial precipitation after aging is preferably enhanced, and the amount of the γ phase is preferably small.

TABLE 4

| | | Material | Heat condition | | | | DSC evaluation | | |
|---|---|---|---|---|---|---|---|---|---|
| | Material | Material temperature ° C. | Heating plate temperature ° C. | Contact time sec | Heating rate ° C./sec | Processing ratio % | Initial precipitation phase | Later precipitation phase | Peak position |
| Example 18 | Cu—Be alloy | 25 | 231 | 3 | 69 | 0 | ○ | ○ | ◎ |
| Example 19 | Cu—Be alloy | 25 | 290 | 3 | 88 | 0 | ◎ | ◎ | ◎ |
| Example 20 | Cu—Be alloy | 25 | 260 | 1 | 235 | 0 | ◎ | ◎ | ◎ |
| Example 21 | Cu—Be alloy | 25 | 260 | 3 | 78 | 0 | ◎ | ◎ | ◎ |
| Example 22 | Cu—Be alloy | 93 | 260 | 3 | 56 | 0 | ○ | ○ | ◎ |
| Example 23 | Cu—Ni—Si alloy | 25 | 400 | 3 | 125 | 0 | ◎ | ◎ | ◎ |
| Example 24 | Cu—Ti alloy | 25 | 350 | 3 | 108 | 0 | ◎ | ○ | ◎ |
| Example 25 | Cu—Cr—Zr alloy | 25 | 350 | 3 | 108 | 0 | ◎ | ○ | ◎ |
| Example 26 | 6061Al alloy | 25 | 150 | 3 | 42 | 0 | ◎ | ○ | ◎ |
| Example 27 | SUS304 alloy | 25 | 400 | 3 | 125 | 0 | ◎ | ◎ | ○ |
| Comparative example 13 | Cu—Be alloy | 25 | 260 | 3.2 | 73 | 0 | ◎ | Δ | ◎ |
| Comparative example 14 | Cu—Be alloy | 25 | 25 | 3 | 0 | 0 | ◎ | Δ | ○ |
| Comparative example 15 | Cu—Ni—Si alloy | 25 | 350 | 3 | 108 | 0 | ◎ | Δ | ◎ |
| Comparative example 16 | Cu—Ti alloy | 25 | 300 | 3 | 92 | 0 | ○ | Δ | ◎ |
| Comparative example 17 | Cu—Cr—Zr alloy | 25 | 300 | 3 | 92 | 0 | ◎ | Δ | ○ |
| Comparative example 18 | 6061Al alloy | 25 | 210 | 3 | 62 | 0 | ◎ | Δ | ◎ |
| Comparative example 19 | SUS304 alloy | 25 | 470 | 3 | 148 | 0 | ◎ | Δ | ○ |

TABLE 5

| | ◎ | ○ | Δ |
|---|---|---|---|
| G-P zone | 101 or more | 80 or more and less than 101 | Less than 80 |
| γ | Less than 101 | 101 or more and 131 or less | More than 131 |
| Deviation of peak position | −10° C. or more and less than 5° C. | 5° C. or more and 10° C. or less | Less than −10° C. or more than 10° C. |

TABLE 6

| | Example 18 231° C. 3.0 sec | | Example 19 290° C. 3.0 sec | | Comparative example 14 25° C. 3.0 sec | |
|---|---|---|---|---|---|---|
| G-P zone | 85 | ○ | 102 | ◎ | 101 | ◎ |
| γ'' | 50 | | 19 | | 37 | |
| γ' | 55 | | 28 | | 20 | |
| γ | 115 | ○ | 72 | ◎ | 148 | Δ |
| Total amount | 305 | | 221 | | 306 | |

Examples 28 and 29

In Examples 28 to 41, the thickness of the alloy ribbons was studied in further detail. In these examples, the same preliminary-state-generating step as in Example 1 was performed on a Cu—Be alloy ribbon (the same as in Example 1) kept at 25° C. In Example 28, the preliminary-state-generating step was conducted on a Cu—Be alloy ribbon having a thickness of 0.25 mm so that the surface temperatures of the heating plates were 280° C., the contact time between the heating plates and the alloy ribbon was 3.0 sec, and the processing ratio dh (%) was 3.0%. The heating rate was 85° C./sec. In Example 29, the preliminary-state-generating step was conducted on a Cu—Be alloy ribbon having a thickness of 0.25 mm as in Example 28 except that the processing ratio dh (%) was 5.0%.

Examples 30 and 31

In Example 30, the same preliminary-state-generating step as in Example 28 was performed except that the thickness of the Cu—Be alloy ribbon was 1.50 mm. In Example 31, the same preliminary-state-generating step as in Example 28 was performed except that the thickness of the Cu—Be alloy ribbon was 1.50 mm and the processing ratio dh (%) was 5.0%.

Examples 32 and 33

In Example 32, the same preliminary-state-generating step as in Example 28 was performed except that the thickness of the Cu—Be alloy ribbon was 3.00 mm. In Example 33, the same preliminary-state-generating step as in Example 28 was performed except that the thickness of the Cu—Be alloy ribbon was 3.00 mm and the processing ratio dh (%) was 5.0%.

Comparative Examples 20 and 21

In Comparative Example 20, the same preliminary-state-generating step as in Example 28 was performed except that the thickness of the Cu—Be alloy ribbon was 3.20 mm. In Comparative Example 21, the same preliminary-state-generating step as in Example 28 was performed except that the thickness of the Cu—Be alloy ribbon was 3.20 mm and the processing ratio dh (%) was 5.0%.

Comparative Example 22

In Comparative Example 22, the same treatment as in Example 28 was performed except that the contact time between the heating plates and the alloy ribbon was 0 sec, i.e., the heating plates were not brought into contact with the alloy ribbon.

Examples 34 and 35

In Example 34, the same preliminary-state-generating step as in Example 28 was performed except that a Cu—Ni—Si alloy ribbon (Example 10) having a thickness of 0.25 mm was used and the processing ratio dh (%) was 5.0%. In Example 35, the same preliminary-state-generating step as in Example 28 was performed except that a Cu—Ni—Si alloy ribbon having a thickness of 1.50 mm was used and the processing ratio dh (%) was 5.0%.

Examples 36 and 37

In Example 36, the same preliminary-state-generating step as in Example 28 was performed except that a Cu—Ti alloy ribbon (Example 12) having a thickness of 0.25 mm was used and the processing ratio dh (%) was 5.0%. In Example 37, the same preliminary-state-generating step as in Example 28 was performed except that a Cu—Ti alloy ribbon having a thickness of 1.50 mm was used and the processing ratio dh (%) was 5.0%.

Examples 38 and 39

In Example 38, the same preliminary-state-generating step as in Example 28 was performed except that a Cu—Cr—Zr alloy ribbon (Example 14) having a thickness of 0.25 mm was used and the processing ratio dh (%) was 5.0%. In Example 39, the same preliminary-state-generating step as in Example 28 was performed except that a Cu—Cr—Zr alloy ribbon having a thickness of 1.50 mm was used and the processing ratio dh (%) was 5.0%.

Examples 40 and 41

In Example 40, the same preliminary-state-generating step as in Example 28 was performed except that a 6061 aluminum alloy ribbon (Example 16) having a thickness of 0.25 mm was used, the surface temperatures of the heating plates were 200° C., the contact time between the heating plates and the alloy ribbon was 3.0 sec, and the processing ratio dh (%) was 5.0. The heating rate was 58.0° C./sec. In Example 41, the same preliminary-state-generating step as in Example 28 was performed except that a SUS304 alloy ribbon (Example 17) having a thickness of 0.25 mm was used, the surface temperatures of the heating plates were 400° C., the contact time between the heating plates and the alloy ribbon was 3.0 sec, and the processing ratio dh (%) was 5.0%. The heating rate was 125° C./sec.

Comparative Examples 23 to 27

In Comparative Example 23, the same preliminary-state-generating step as in Example 34 was performed except that the thickness of the Cu—Ni—Si alloy ribbon was 3.10 mm. In Comparative Example 24, the same preliminary-state-generating step as in Example 36 was performed except that the thickness of the Cu—Ti alloy ribbon was 3.20 mm. In Comparative Example 25, the same preliminary-state-generating step as in Example 38 was performed except that the thickness of the Cu—Cr—Zr alloy ribbon was 3.20 mm. In Comparative Example 26, the same preliminary-state-generating step as in Example 40 was performed except that the thickness of the 6061 aluminum alloy ribbon was 3.2 mm. In Comparative Example 27, the same preliminary-state-generating step as in Example 41 was performed except that the thickness of the SUS304 alloy ribbon was 3.2 mm.

(Measurement of Cross-Sectional Hardness and Surface Hardness)

The cross-sectional hardness and the surface hardness of a sample (before age-hardening treatment) obtained through the preliminary-state-generating step were measured. The measurement was carried out with a Vickers hardness meter (Mitutoyo HM-115) under a load of 300 g. A cross-section and a surface of the obtained sample were separately measured and the results were used as the cross-sectional hardness (Hv) and the surface hardness (Hv). Measurement on the cross-section was done by embedding the sample in a resin so that the sample extended in the longitudinal direction of a columnar shape, cutting the columnar-shaped sample embedded in the resin so that a cross-section of the sample is exposed, polishing the exposed surface, and then measuring the hardness of the central portion of the alloy ribbon in the thickness direction. A sample in which the difference between the cross-sectional hardness and the surface hardness was 10 Hv or less in terms of Vickers hardness was evaluated as more favorable.

(X-Ray Diffractometry)

Figure 13:
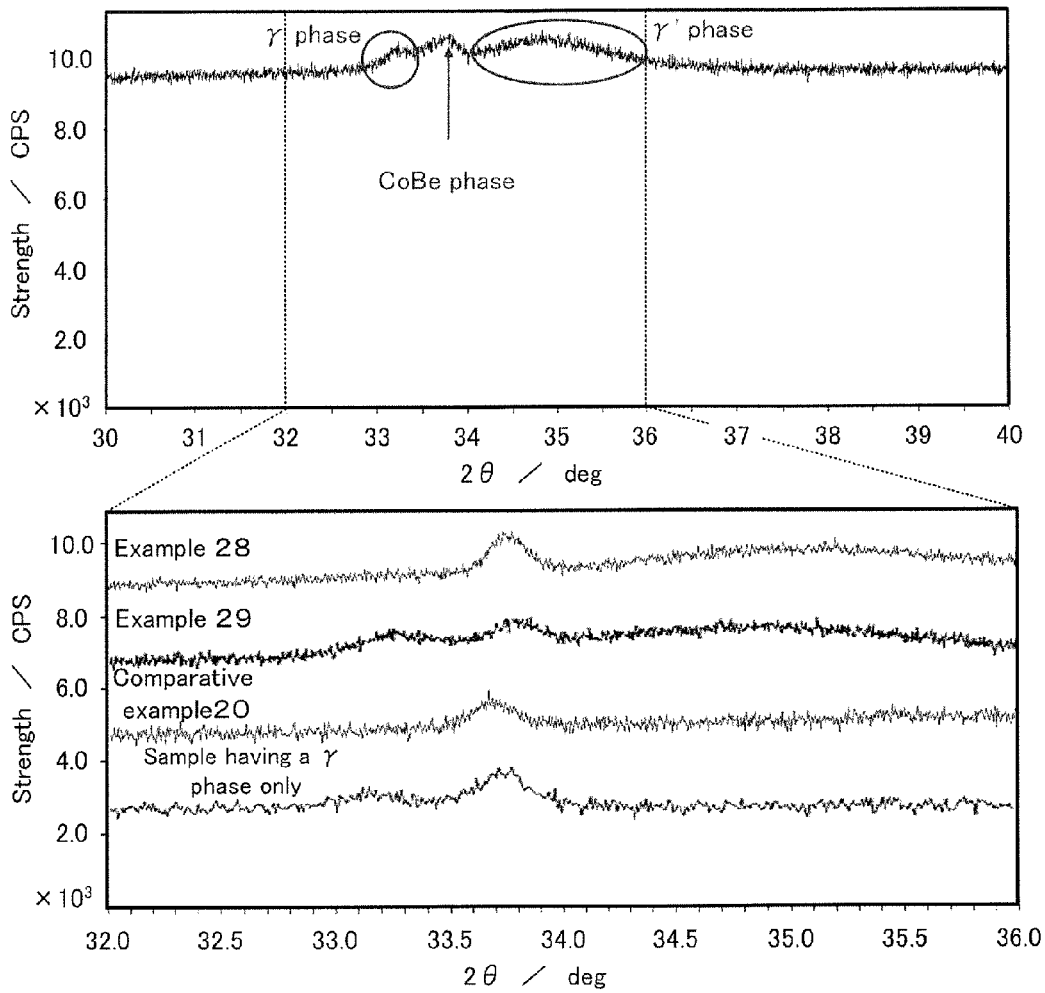
FIG. 13 shows X-ray diffractometry results of Examples 28 and 29 and Comparative Example 20.

A sample (before age-hardening treatment) obtained through the preliminary-state-generating step was subjected to X-ray diffractometry. Measurement was carried out with an X-ray diffractometer results (Rigaku RINT1400) using a CuKα line at 20=30° to 40°. FIG. 13 shows the outline of the X-ray diffractometry of the alloy ribbons of Examples 28 and 29 and Comparative Example 20. The measurement results of a sample having a γ phase, a γ' phase, and a CoBe phase and a sample having a γ phase only are also included in FIG. 13. FIG. 13 shows that precipitation of the γ phase was suppressed more in Examples.

(Evaluation Results)

Table 7 is a table that shows the evaluation results of Examples 28 to 41 and Comparative Examples 20 to 27. Table 7 indicates the type of raw material, thickness (mm), the material temperature (° C.) before the preliminary-state-generating treatment, the heating plate temperature (° C.), the contact time (sec), the heating rate (° C./sec), the processing ratio (I), the cross-sectional hardness (Hv), the surface hardness (Hv), and whether γ phase and γ' phase were precipitated. The later precipitation phase is a γ phase for Cu—Be alloys, a β phase for Al 6000 series alloys, and a σ phase for SUS304 series alloys. The initial precipitation phase is γ' phase for Cu—Be alloys, and a β" phase for Al 6000 series alloys. As shown in Table 7, in Examples 28 to 41 in which the thickness was 0.25 to 3.00 mm, the difference between the cross-sectional hardness and the surface hardness is small, thereby indicating that the cross-section and the surface are similar, i.e., that the sample is composed of a more homogeneous material. In contrast, in Comparative Examples 20, 21, and 23 to 27 in which the thickness exceeded 3.00 mm, the difference in hardness between the cross-section and the surface was large and the material was not homogeneous. In Comparative Example 20 to 27, the later precipitation phase such as a γ phase was absent, and the initial precipitation phase such as γ' phase was also absent. In Contrast, in Examples 28 to 41, the later precipitation phase such as a γ phase was rarely present and most of the phases were the initial precipitation phase such as γ' phase. Accordingly, it was found that, in Examples 28 to 41 in which the thickness was 0.25 to 3.00 mm, the initial precipitation phase such as a γ' phase was precipitated and a more favorable state was generated.

TABLE 7

| | Material | Thickness (mm) | Material temperature (° C.) | Heating plate temperature (° C.) | Contact time (sec) | Heating rate (° C./sec) | Processing ratio (%) | Cross-sectional hardness[1)] (Hv) | Surface hardness[1)] (Hv) | Later precipitation phase[2)] | Initial precipitation phase[3)] |
|---|---|---|---|---|---|---|---|---|---|---|---|
| Example 28 | Cu—Be alloy | 0.25 | 25 | 280 | 3 | 85 | 3 | 126 | 130 | Absent | Present |
| Example 29 | Cu—Be alloy | | 25 | 280 | 3 | 85 | 5 | 135 | 138 | Present a little | Present |
| Example 30 | Cu—Be alloy | 1.50 | 25 | 280 | 3 | 85 | 3 | 124 | 131 | Absent | Present |
| Example 31 | Cu—Be alloy | | 25 | 280 | 3 | 85 | 5 | 133 | 138 | Absent | Present |
| Example 32 | Cu—Be alloy | 3.00 | 25 | 280 | 3 | 85 | 3 | 123 | 133 | Absent | Present a little |
| Example 33 | Cu—Be alloy | | 25 | 280 | 3 | 85 | 5 | 129 | 137 | Absent | Present |
| Comparative example 20 | Cu—Be alloy | 3.20 | 25 | 280 | 3 | 85 | 3 | 119 | 130 | Absent | Absent |
| Comparative example 21 | Cu—Be alloy | | 25 | 280 | 3 | 85 | 5 | 121 | 138 | Absent | Absent |
| Comparative example 22 | Cu—Be alloy | 0.25 | 25 | 280 | 0 | — | 0 | 115 | 118 | Absent | Absent |
| Example 34 | Cu—Ni—Si alloy | 0.25 | 25 | 280 | 3 | 85 | 5 | 79 | 81 | Present a little | Present |
| Example 35 | Cu—Ni—Si alloy | 1.5 | 25 | 280 | 3 | 85 | 5 | 74 | 82 | Absent | Present |
| Example 36 | Cu—Ti alloy | 0.25 | 25 | 280 | 3 | 85 | 5 | 94 | 98 | Absent | Present |
| Example 37 | Cu—Ti alloy | 1.5 | 25 | 280 | 3 | 85 | 5 | 91 | 97 | Absent | Present |
| Example 38 | Cu—Cr—Zr alloy | 0.25 | 25 | 280 | 3 | 85 | 5 | 81 | 83 | Absent | Present |
| Example 39 | Cu—Cr—Zr alloy | 1.5 | 25 | 280 | 3 | 85 | 5 | 77 | 83 | Absent | Present |
| Example 40 | 6061Al alloy | 0.25 | 25 | 200 | 3 | 58 | 5 | 51 | 53 | Absent | Present |
| Example 41 | SUS304 alloy | 0.25 | 25 | 400 | 3 | 125 | 5 | 167 | 172 | Absent | Present |
| Comparative example 23 | Cu—Ni—Si alloy | 3.1 | 25 | 280 | 3 | 85 | 5 | 67 | 81 | Absent | Absent |
| Comparative example 24 | Cu—Ti alloy | 3.2 | 25 | 280 | 3 | 85 | 5 | 85 | 98 | Absent | Absent |
| Comparative example 25 | Cu—Cr—Zr alloy | 3.2 | 25 | 280 | 3 | 85 | 5 | 71 | 82 | Absent | Absent |
| Comparative example 26 | 6061Al alloy | 3.2 | 25 | 200 | 3 | 58 | 5 | 41 | 52 | Absent | Absent |
| Comparative example 27 | SUS304 alloy | 3.2 | 25 | 400 | 3 | 125 | 5 | 158 | 171 | Absent | Absent |

[1)]Vickers hardness measurement condition: The measurement was carried out with a Vickers hardness meter (Mitutoyo HM-115) under a load of 300 g.
[2)]Later precipitation phase: γ phase for Cu—Be alloy, β phase for Al6000 alloy, and σ phase for SUS304 alloy.
[3)]Initial precipitation phase: γ' phase for Cu—Be alloy and β" phase for Al6000 alloy.

The present application claims priority from Japanese Patent Application No. 2010-245515 filed on Nov. 1, 2010, the entire contents of which is incorporated in the present specification by reference.

INDUSTRIAL APPLICABILITY

The present invention is applicable to the field of alloy processing.

The invention claimed is:

1. A heat treatment method for heat-treating an alloy that undergoes multiple-step transformation with temperature, the method comprising:

a preliminary-state-generating step of heat-treating the alloy by bringing the alloy in contact with a contact-type heating element for 0.01 sec or more and 3.0 sec or less, the contact-type heating element being adjusted to a particular temperature within a preliminary-state-generating temperature region determined on the basis of a first temperature related to a particular first transformation of the alloy and a second temperature, which is higher than the first temperature, related to a particular second transformation of the alloy so as to generate a preliminary state in the alloy.

2. The heat treatment method according to claim 1, wherein the first temperature is a peak temperature of the first transformation of the alloy determined by differential scanning calorimetry, the second temperature is a temperature of a rising edge of the second transformation determined by differential scanning calorimetry, and the preliminary-state-generating temperature region is a temperature region higher than the first temperature and lower than the second temperature.

3. The heat treatment method according to claim 1, wherein, in the preliminary-state-generating step, a pair of heating rolls equipped with a heating mechanism is used as the contact-type heating element and the heat treatment is carried out while continuously moving the alloy sandwiched between the pair of heating rolls.

4. The heat treatment method according to claim 1, wherein, in the preliminary-state-generating step, the heat treatment is conducted while rolling the alloy so that the reduction achieved by the contact-type heating element is 0.01% or more and 10% or less.

5. The heat treatment method according to claim 1, further comprising, after the preliminary-state-generating step:

a main heat treatment step of heating and cooling the alloy that has been subjected to the preliminary-state-generating step.

6. The heat treatment method according to claim 5, wherein the first temperature and the second temperature are each a temperature related to a transformation and determined by subjecting the alloy to differential scanning calorimetry at a heating rate determined on the basis of a heating rate during heating in the main heat treatment step.

7. The heat treatment method according to claim 1, wherein, in the preliminary-state-generating step, an alloy formed to a thickness of 3.0 mm or less is used.

8. The heat treatment method according to claim 1, wherein, in the preliminary-state-generating step, the range of the heating rate of the alloy is 70° C./sec or more and 2500° C./sec or less.

9. The heat treatment method according to claim 8, wherein, in the preliminary-state-generating step, the heating rate of the alloy is 180° C./sec or more and preferably 200° C./sec or more.

10. The heat treatment method according to claim 1, wherein the alloy is one or more of a copper alloy and an aluminum alloy.

* * * * *